US008070458B2

(12) United States Patent
Meza

(10) Patent No.: US 8,070,458 B2
(45) Date of Patent: Dec. 6, 2011

(54) PUMP APPARATUS AND METHOD

(75) Inventor: Humberto V. Meza, Tustin, CA (US)

(73) Assignee: Hypro, LLC, New Brighton, MN (US)

( * ) Notice: Subject to any disclaimer, the term of this patent is extended or adjusted under 35 U.S.C. 154(b) by 124 days.

(21) Appl. No.: 12/570,863

(22) Filed: Sep. 30, 2009

(65) Prior Publication Data

US 2010/0021312 A1 Jan. 28, 2010

Related U.S. Application Data

(62) Division of application No. 11/480,343, filed on Jun. 30, 2006, now abandoned.

(51) Int. Cl.
*F04B 49/06* (2006.01)

(52) U.S. Cl. ..... 417/44.9; 417/44.2; 417/53

(58) Field of Classification Search ..... 417/44.2, 417/44.7, 44.8, 44.9, 53
See application file for complete search history.

(56) References Cited

U.S. PATENT DOCUMENTS 5,352,096 A * 10/1994 Chi-Wen ..... 417/12
5,482,439 A * 1/1996 Chen ..... 417/44.8
6,607,360 B2 8/2003 Fong

* cited by examiner

*Primary Examiner* — Charles Freay

(57) ABSTRACT

Pump apparatus and method. The pump can include a valve assembly and a diaphragm. In some embodiments, the diaphragm can include a convolute that can deform in order to increase a volume of a pumping chamber to provide an internal fluid bypass when a pressure in the pumping chamber exceeds a bypass pressure. In some embodiments, the pump can include a fluid reservoir at least partially defined by a wall with a flow-restrictive conduit in fluid communication with an outlet chamber. A shut-off switch can include an actuator in fluid communication with the fluid reservoir. The fluid reservoir and the flow-restrictive conduit can substantially isolate the shut-off switch from pressure pulses in the outlet chamber.

20 Claims, 15 Drawing Sheets

PUMP APPARATUS AND METHOD

RELATED APPLICATIONS

This application is a divisional of U.S. patent application Ser. No. 11/480,343, field on Jun. 30, 2006 now abandoned the entire contents of which are incorporated herein by reference.

FIELD OF THE INVENTION

His invention relates generally to pumps and pumping methods, and more particularly to wobble plate pumps and pump controls.

BACKGROUND OF THE INVENTION

Wobble plate pumps typically include pistons that move in a reciprocating manner within corresponding pumping chambers. The pistons are generally coupled to a wobble plate and are reciprocated by a cam that is rotated by a motor or other driving device. The reciprocating movement of the pistons pumps fluid from a fluid inlet to a fluid outlet of the pump. The pistons of the pump are often coupled to a diaphragm that is positioned between the wobble plate and the pump chambers. In some such pumps, each one of the pistons is an individual component separate from the diaphragm, requiring numerous components to be manufactured and assembled. A convolute is sometimes employed to connect each piston to the diaphragm, so that the pistons can reciprocate and move with respect to the remainder of the diaphragm.

Some conventional pumps (including wobble plate pumps) have a bypass port which allows for fluid entering the pump to bypass the pumping chambers when the pressure at the outlet side of the pump is high. This helps to reduce the "water hammering" noise that occurs when a downstream valve is limiting the flow rate but the pump is still trying to push water at its nominal flow rate. However, the bypass of fluid comes at the expense of pump efficiency. It also requires the design and manufacture of a separate fluid path.

Many conventional pumps include a controller or switch for controlling the on-off state of the pump, especially for shutting off the pump in response to increased pressure (i.e., a shut-off pressure). For example, an actuator of a mechanical switch is typically positioned in physical communication with the fluid in the pump. When the pressure of the fluid exceeds the shut-off pressure, the force of the fluid moves the actuator to open the pump's power circuit to turn off the pump.

Mechanical pressure switches may be susceptible to breakdown due to overuse. For example, during repeated opening and closing of the pump's power circuit, arcing and scorching often occurs between the contacts of the switch. Due to this arcing and scorching, an oxidation layer forms over the contacts of the switch, and the switch will eventually be unable to close the pump's power circuit. Repeated switching may occur because mechanical pressure switches may react to pressure pulses within the pump. For example, if a wobble plate pump has three chambers, each rotation of the motor will cause three pressure pulses or pumping strokes. If the pressure switch reacts to a pressure pulse rather than the net operating fluid pressure at the outlet, unnecessary cycling will occur. Complex circuits and/or programming have been used in some applications to determine the net pressure and avoid unnecessary cycling, but this solution is often too complex and costly. Repeated cycling results in louder operation with the motor being energized and de-energized frequently. This is particularly undesirable in a non-industrial application, such as a pump in a recreational vehicle or in a home.

SUMMARY OF THE INVENTION

Some embodiments of the invention provide a pump including a valve assembly partially defining a pumping chamber and a diaphragm coupled to the valve assembly. The diaphragm can also partially define the pumping chamber. The diaphragm can include a convolute that can deform in order to increase a volume of the pumping chamber to provide an internal fluid bypass when a pressure in the pumping chamber exceeds a bypass pressure.

In some embodiments, the invention provides a pump including a pump head assembly defining an outlet chamber and a fluid reservoir at least partially defined by a wall. The wall can include a flow-restrictive conduit in fluid communication with the outlet chamber. The pump can also include a shut-off switch having an actuator in fluid communication with the fluid reservoir. The fluid reservoir and the flow-restrictive conduit can substantially isolate the shut-off switch from pressure pulses in the outlet chamber.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
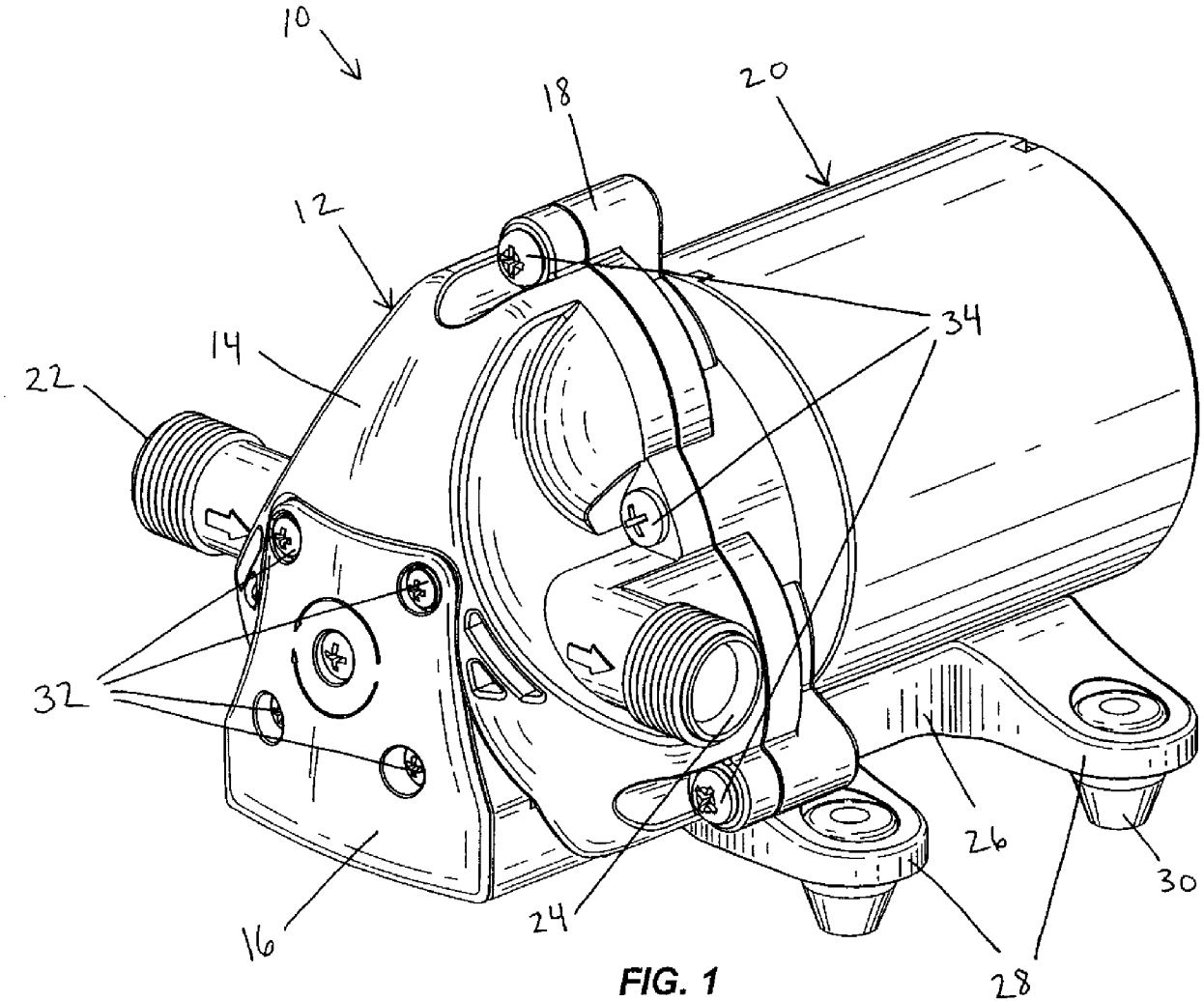
FIG. 1 is a perspective view of a pump according to one embodiment of the invention.
Figure 2:
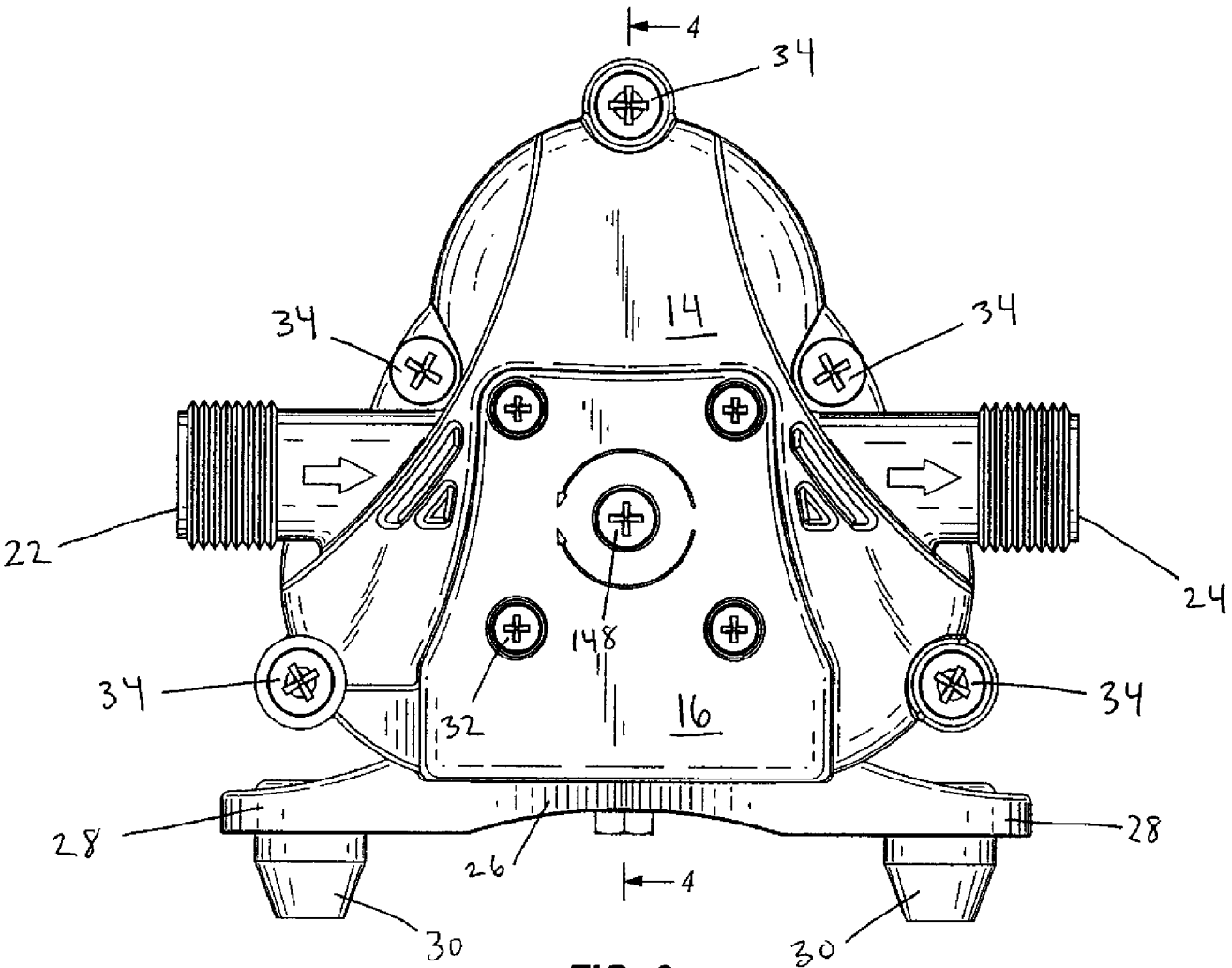
FIG. 2 is a front view of the pump illustrated in FIG. 1.
Figure 3:
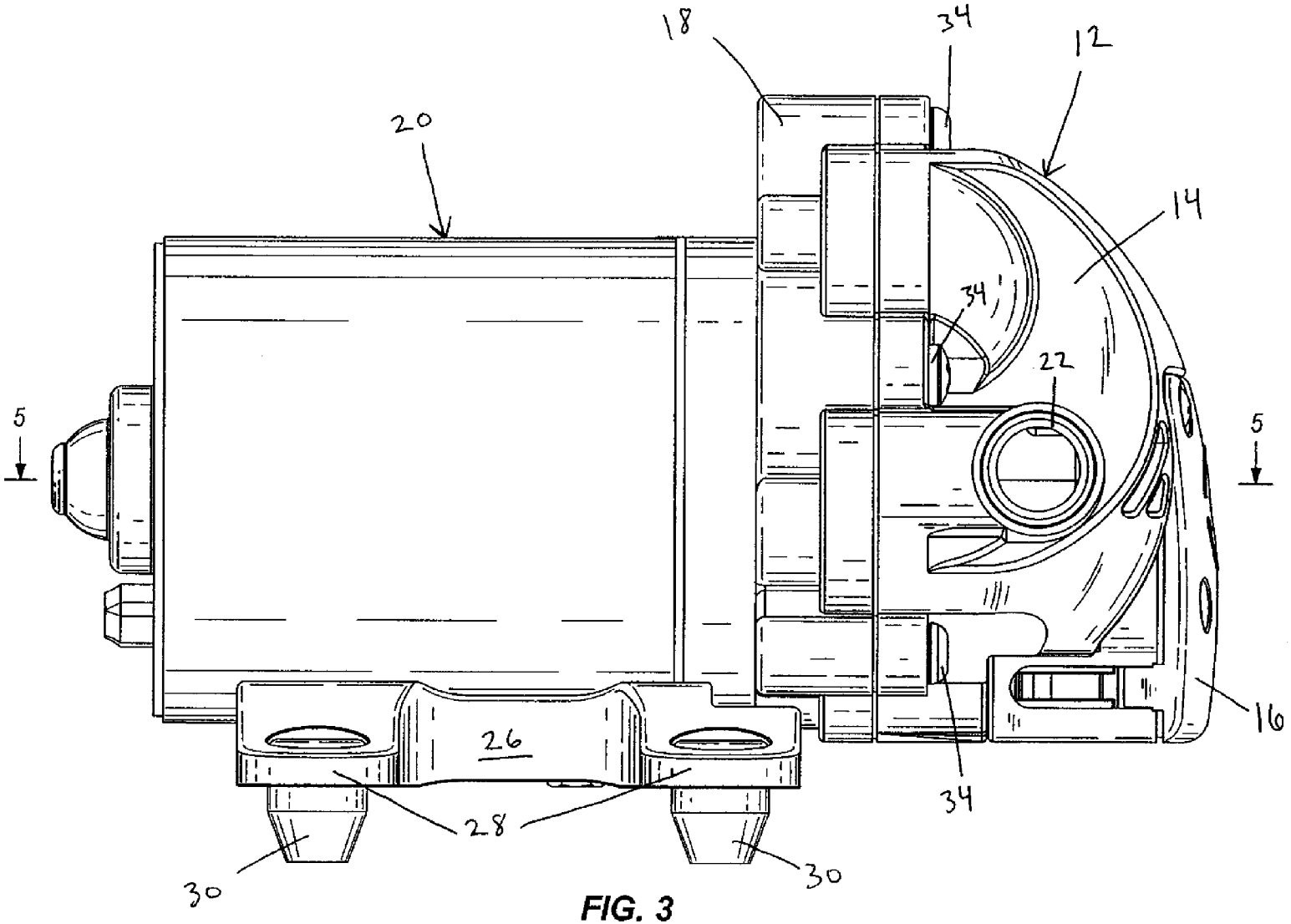
FIG. 3 is a side view of the pump illustrated in FIGS. 1 and 2.

FIGS. 1-3 illustrate the exterior of a pump 10 according to one embodiment of the invention. In some embodiments, the pump 10 can include a pump head assembly 12 having a front housing 14, a switch housing 16 coupled to the front housing 14 by screws 32, and a rear housing 18 coupled to the front housing 14 by screws 34. Although screws 32, 34 are shown being used to connect the sensor housing 16 and rear housing 18 to the front housing 14 as described, other types of fasteners can instead be used (including, without limitation, bolt and nut sets or other threaded fasteners, rivets, clamps, and buckles). The pump head assembly 12 can be defined by housing portions arranged in other manners, such as by left and right housing portions or upper and lower housing portions. Reference herein and in the appended claims to terms of orientation (such as front and rear) are provided for purposes of illustration only and are not intended as limitations upon the invention.

The pump 10 can have a pedestal 26 with legs 28 to support the weight of the pump 10. Alternatively, the pump 10 can include or be connected to a bracket, stand, or another device for mounting and supporting the pump 10 upon a surface in a particular orientation. The legs 28 can each have cushions 30 constructed of a resilient material (such as rubber or urethane) to reduce the transfer of vibration from the pump 10 to the surrounding environment.

The pump head assembly 12 can include a fluid inlet 22 and a fluid outlet 24. In some embodiments, the inlet 22 and the outlet 24 can be formed as part of the front housing 14, but may alternatively be formed separately or as part of the pump 10 in another way. The inlet 22 can be connected to an inlet fluid line (not shown) and the outlet 24 can be connected to an outlet fluid line (not shown). The inlet 22 and the outlet 24 can each be provided with fittings for connection to inlet and outlet fluid lines. The inlet 22 and outlet 24 can be provided with quick-disconnect fittings, although threaded fittings or other connections can instead be used.

Figure 4:
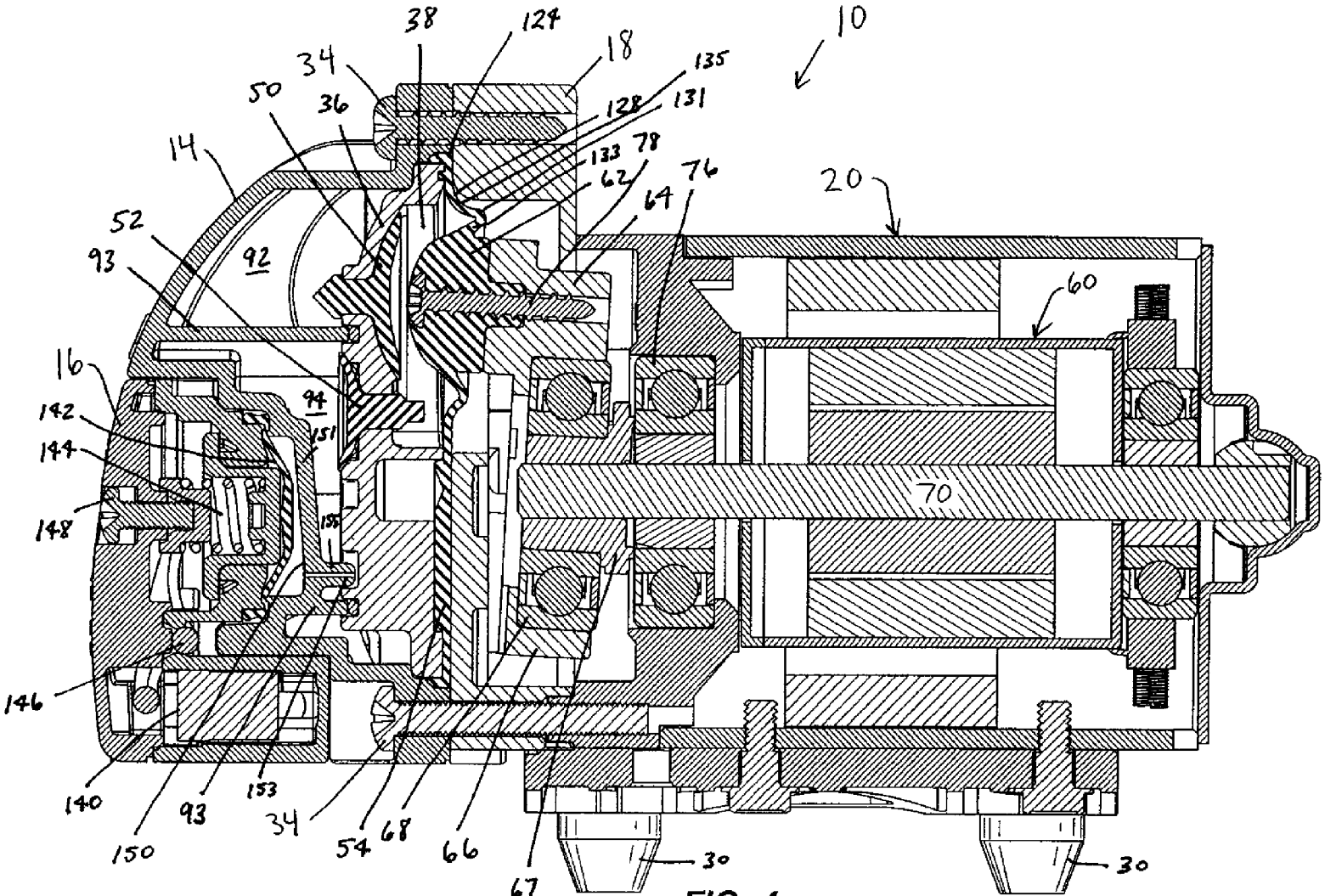
FIG. 4 is a cross-sectional view of the pump illustrated in FIGS. 1-3.
Figure 5:
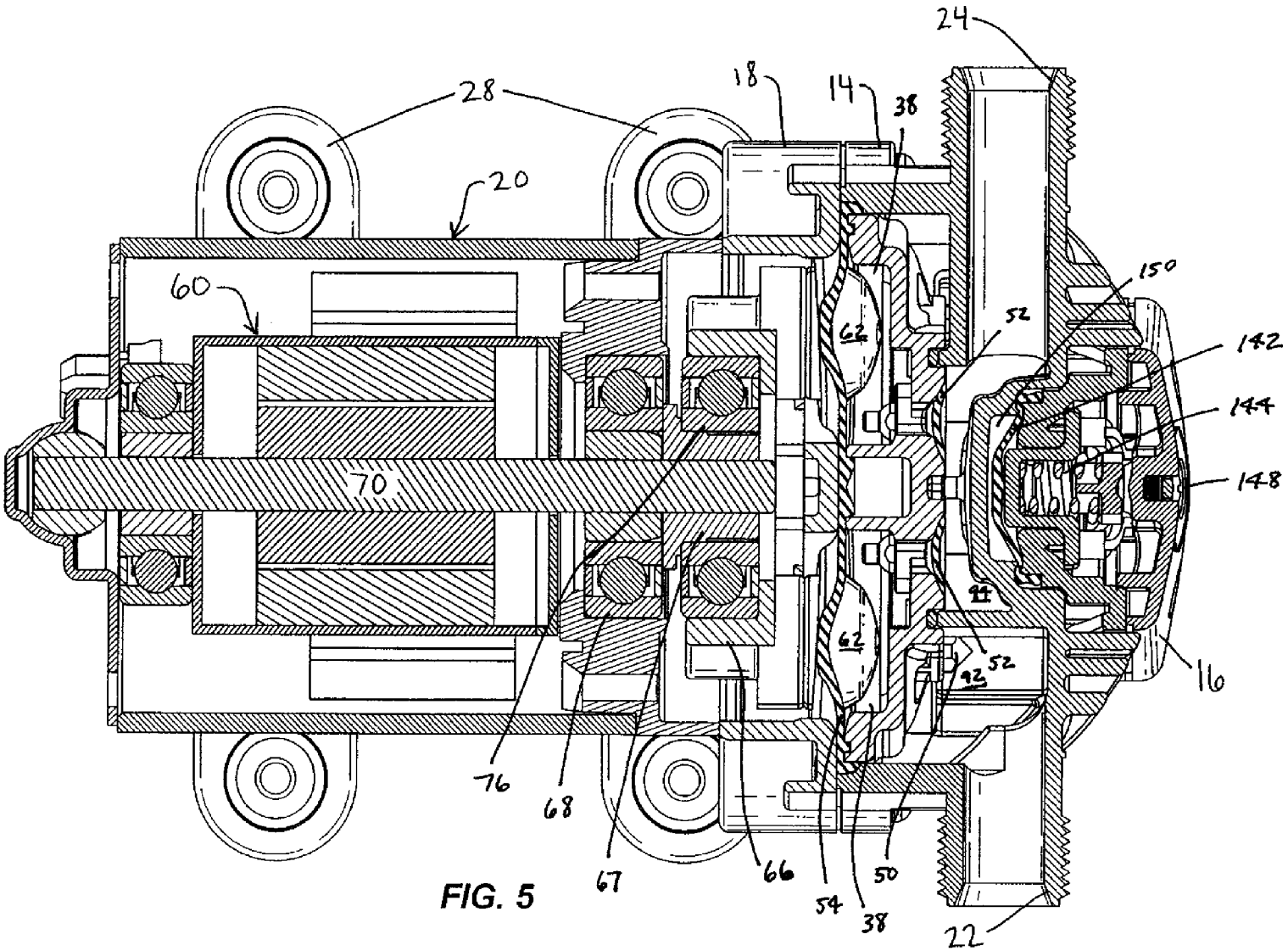
FIG. 5 is a cross-sectional view of the pump illustrated in FIGS. 1-4.

As shown in FIGS. 4 and 5, the pump 10 can be integrated with or can be connected to a motor assembly 20. The motor assembly 20 can include a motor 60 with an output shaft 70. In some embodiments, a direct current electric motor can be included in the motor assembly 20 to rotate the output shaft 70.

Figure 6:
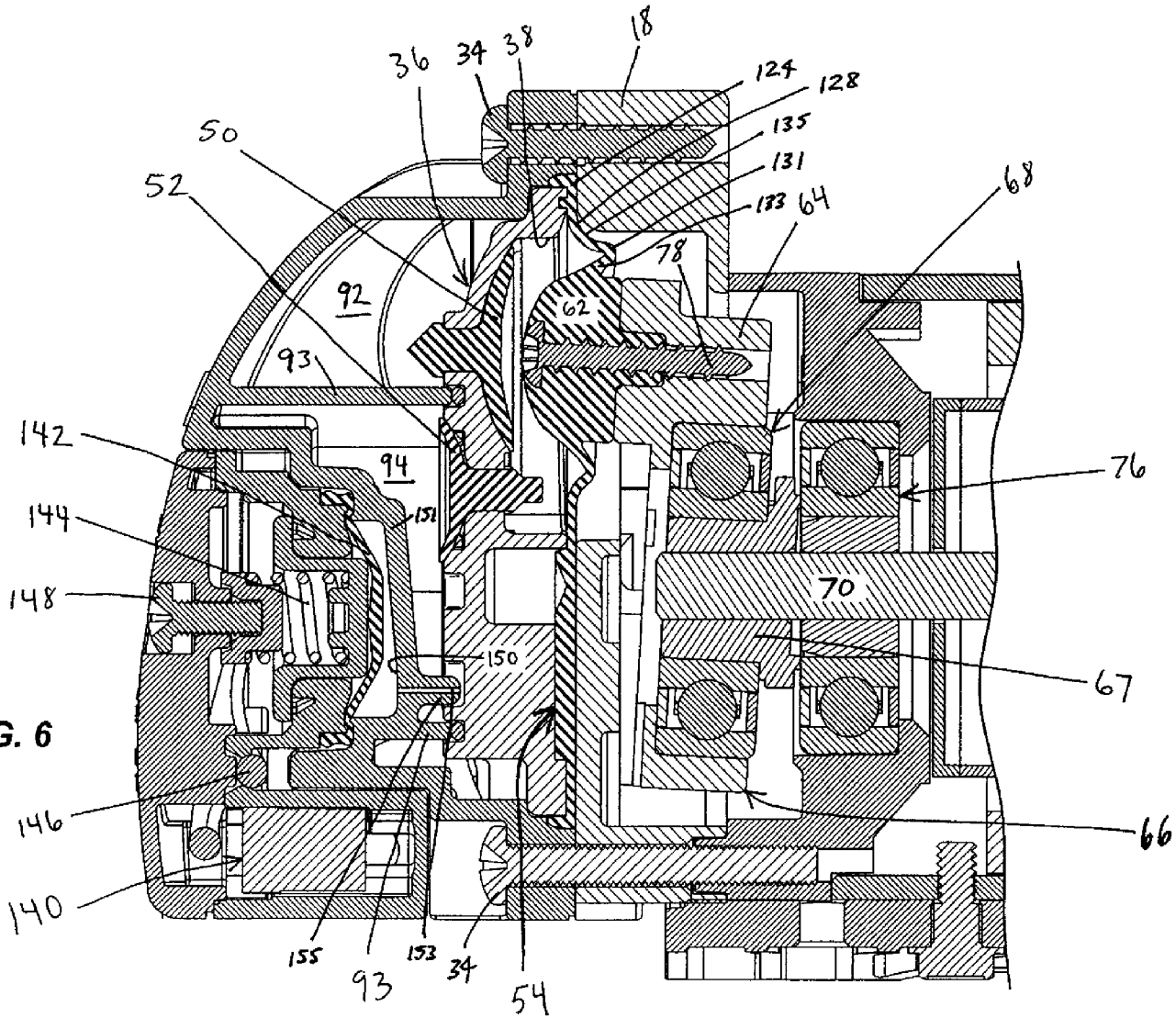
FIG. 6 is a detail cross-sectional view of the pump head assembly enlarged from FIG. 4.
Figure 7:
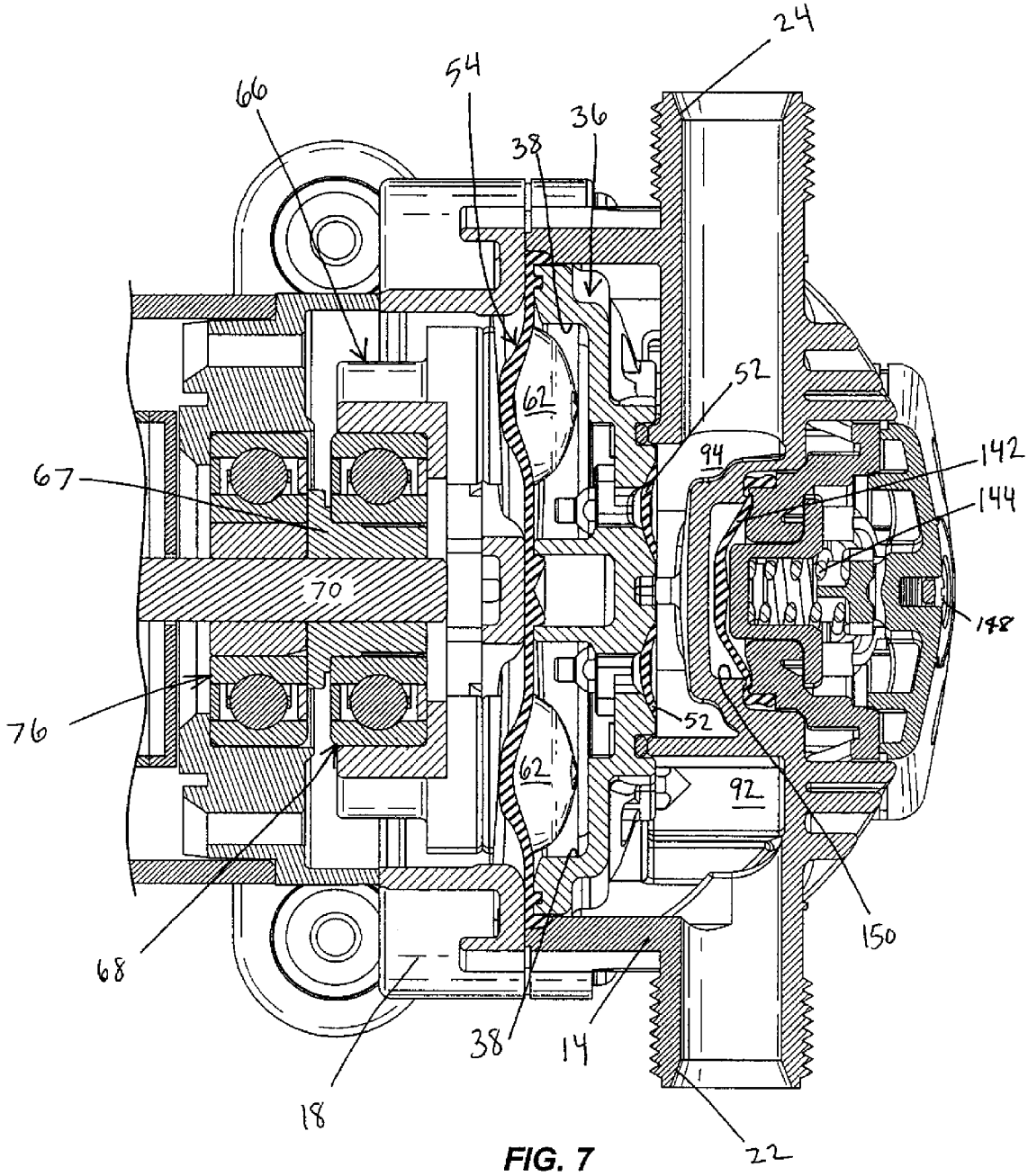
FIG. 7 is a detail cross-sectional view of the pump head assembly enlarged from FIG. 5.

FIGS. 6 and 7 illustrate in detail various aspects of the interior of the pump head assembly 12 according to some embodiments of the invention. A valve assembly 36 can include an inlet valve 50 and an outlet valve 52 for controlling the flow of fluid through a pumping chamber 38. In some embodiments, the pump 10 includes three inlet valves 50, three outlet valves 52, and three pumping chambers 38. However, the pump 10 can include other numbers of pumping chambers 38, such as two, four, five, etc. As shown in FIG. 7, the fluid inlet 22 can open to an inlet chamber 92, which can be in fluid communication with each inlet valve 50 of the pump 10. As shown in FIG. 6, a chamber wall 93 can separate the inlet chamber 92 from the outlet chamber 94. A shut-off switch 140 and a pressure-dampening reservoir 150 can also be located in the pump head assembly 12.

For each one of the pumping chambers 38, the valve assembly 36 can include one inlet valve 50 and one outlet valve 52, but multi-valve configurations can also be used. The inlet valve 50 can be positioned within the valve assembly 36 so that fluid may only enter the pumping chamber 38 through the inlet valve 50 when a lower pressure exists in the pumping chamber 38, as compared to the inlet chamber 92. Also, the outlet valve 52 can be positioned within the valve assembly 36 so that the outlet valve 52 is closed when pressure in the pumping chamber 38 is lower than the outlet chamber 94. When the fluid pressure in the pumping chamber 38 exceeds that of the outlet chamber 94, the outlet valve 52 can open to allow fluid to exit the pumping chamber 38. The inlet and outlet valves 50, 52 can be flexible, one-way valves positioned within valve seats.

A diaphragm 54 can provide pumping action through the pumping chambers 38. The diaphragm 54 can be positioned between the valve assembly 36 and the rear housing 18. A periphery of the diaphragm 54 can be positioned to create a seal between the rear housing 18 and the valve assembly 36 and/or the front housing 14. In some embodiments, the diaphragm 54 can include one piston 62 corresponding to each one of the pumping chambers 38. Movement of the pistons 62 into and out of the pumping chambers 38 can cause the pressure to vary in the pumping chambers 38 in order to move fluid through the inlet and outlet valves 50, 52. The pistons 62 can be formed integrally with the diaphragm 54.

A wobble plate 66 can be positioned in the pump head assembly 12. In some embodiments, the wobble plate 66 can include three rocker arms 64 that can transfer rotational movement from a cam 67 to linear movement of each of the three pistons 62 in turn. As shown in FIGS. 4 and 6, each of the pistons 62 can have an abutting surface coupled to the respective rocker arm 64. In some embodiments, the pistons 62 can be coupled to the rocker arms 64 by screws 78. The pistons 62 can be coupled to the wobble plate 66 in other ways, such as by nut and bolt sets, other threaded fasteners, rivets, by adhesive or cohesive bonding material, or by snap-fit connections.

The wobble plate 66 can be coupled to the cam 67 by a first bearing assembly 68, which can allow the cam 67 to rotate within the wobble plate 66. The cam 67 can be coupled to the output shaft 70 of the motor assembly 20 for rotation with the output shaft 70. In some embodiments, the first bearing assembly 68 can be positioned within the wobble plate 66. As shown in FIG. 7, a second bearing assembly 76 can support the output shaft 70 and can provide a surface in contact with the cam 67. Specifically, as the output shaft 70 rotates, each rocker arm 64 (and respective piston 62) can be sequentially pushed into one of the pumping chambers 38. As a result, each piston 62 can perform one pumping stroke upon one rotation of the output shaft 70.

When actuated, the pistons 62 can move within the pumping chambers 38 in a reciprocating manner. As a given piston 62 moves into the associated pumping chamber 38, the associated inlet valve 50 can be sealed shut and fluid can be forced out of the pumping chamber 38 through the associated outlet valve 52. As the piston 62 moves out of the pumping chamber 38, the inlet valve 50 can open and fluid can be drawn into the pumping chamber 38.

Figure 8:
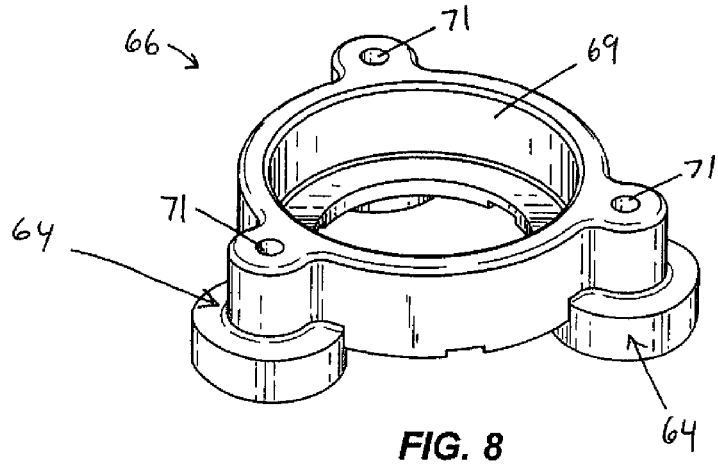
FIG. 8 is a first perspective view of a wobble plate for use with the pump of FIG. 1.
Figure 9:
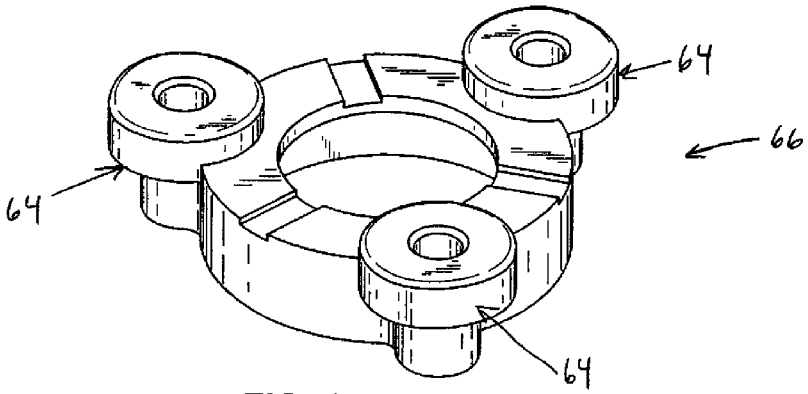
FIG. 9 is a second perspective view of the wobble plate of FIG. 8.
Figure 10:
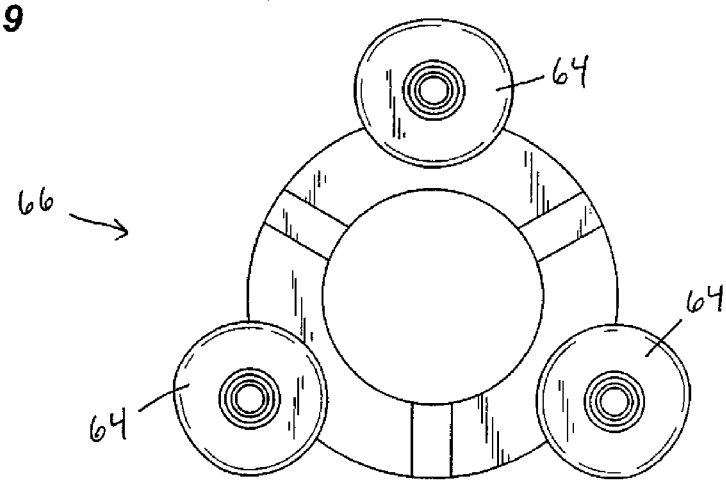
FIG. 10 is a front view of the wobble plate of FIG. 8.

FIGS. 8-10 illustrate the wobble plate 66. The wobble plate 66 can include a central bore 69 that can receive the first bearing assembly 68. The wobble plate 66 can include three rocker arms 64, each including a threaded hole 71 to receive the screw 78 to mount the pistons 62.

Figure 11A:
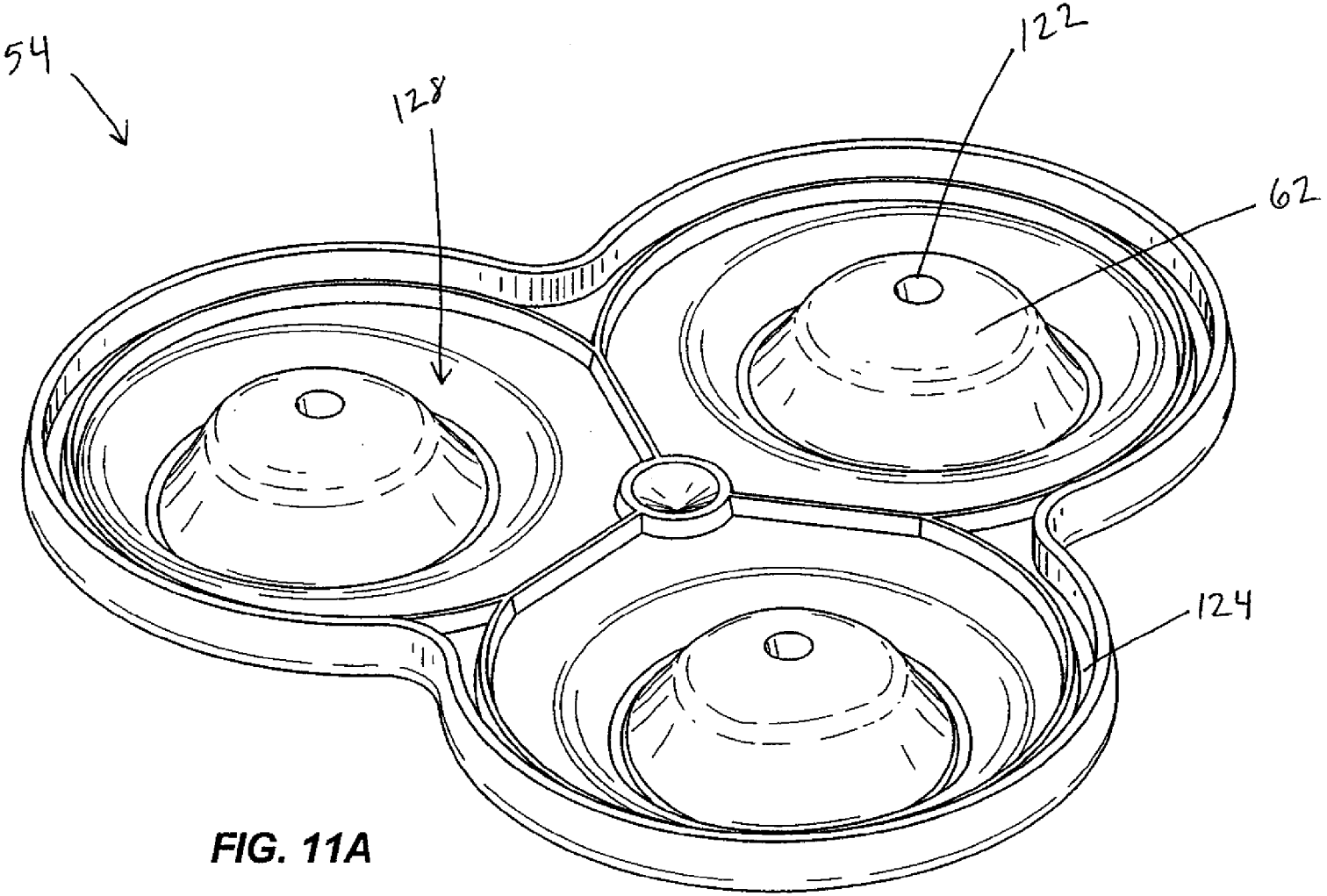
FIG. 11A is a perspective view of a diaphragm according to one embodiment of the invention for use with the pump of FIG. 1.
Figure 13A:
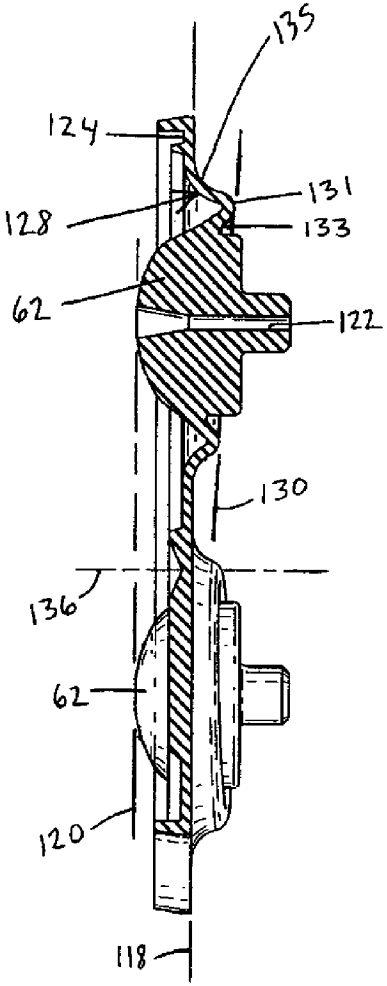
FIG. 13A is a cross-sectional view of the diaphragm of FIGS. 11A and 12A.
Figure 12A:
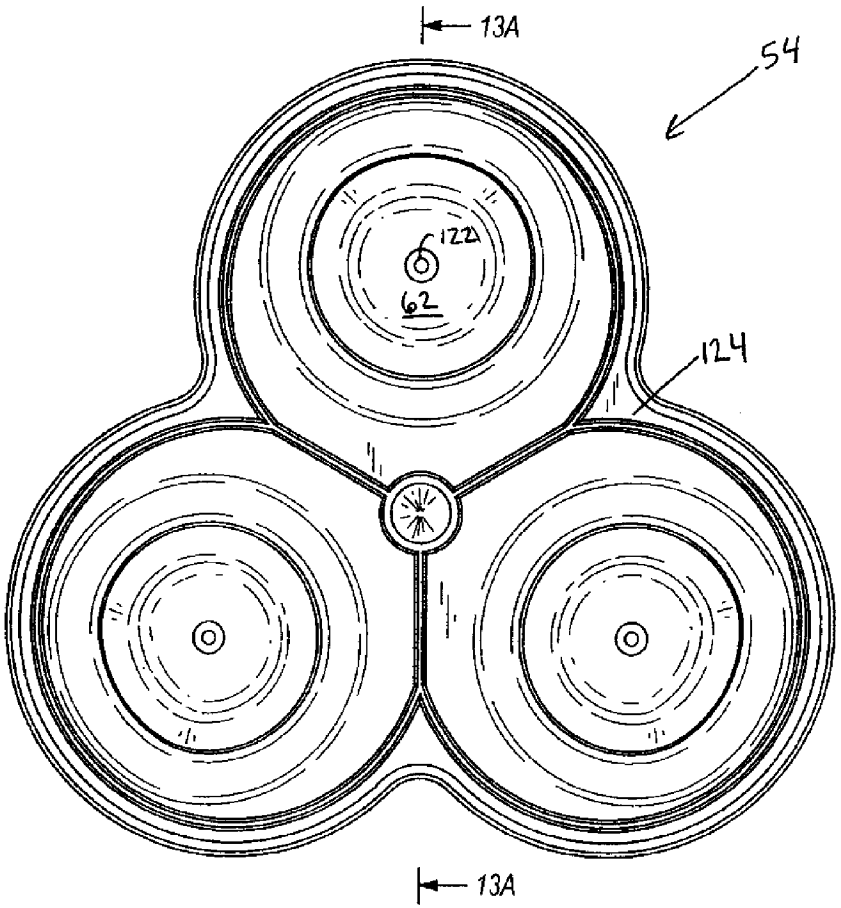
FIG. 12A is a front view of the diaphragm of FIG. 11A.

FIGS. 11A, 12A, and 13A illustrate one embodiment of the diaphragm 54. The diaphragm 54 can include a single piece of resilient material, which can also include each of the pistons 62. In some embodiments, the diaphragm 54 can be constructed of Santoprene® 271-73, but other resilient materials can also be used. As shown in FIG. 13A, the diaphragm 54 can lie generally in a first plane 118. The pistons 62 can lie generally in a second plane 120, which can be parallel to the first plane 118.

In some embodiments, each piston 62 can include an aperture 122 at its center through which a fastener (e.g., the screw 78 as shown in FIG. 6) can be received for connecting each piston 62 to each respective rocker arm 64. In some embodiments, the diaphragm 54 can include a channel 124 extending around a perimeter of the diaphragm 54. The channel 124 can fit together with the valve assembly 36 (as illustrated in FIGS. 4-7) to form a seal and partially define each one of the pumping chambers 38. In some embodiments, the diaphragm 54 does not have a channel 124 as described, but has a sealing relationship with the valve assembly 36, or another portion of the pump head assembly 12, to isolate the pumping chambers 38 from each other and the outside of the pump 10. In some embodiments, the pumping chambers 38 can be isolated from one another by respective seals or one or more gaskets.

The diaphragm 54 can include a convolute 128 around each one of the pistons 62. The convolutes 128 can integrally couple the pistons 62 to the diaphragm 54. As shown in FIG. 13A, each convolute 128 can include a trough portion 131, an inner annulus 133, and an outer annulus 135. The convolutes 128 can allow the pistons 62 to move relative to the first plane 118 during a pumping stroke. In some embodiments, the convolutes 128 can move without placing damaging stresses upon the diaphragm 54. The convolutes 128 can provide a rolling/unrolling edge to permit the pistons 62 to move with respect to the diaphragm 54. As shown in FIG. 13A, each convolute 128 can lie generally in a third plane 130. The third plane 130 can be angled with respect to the first plane 118 so that the trough portion 131 of the convolute 128 is further from the first plane 118 at the outer edge of the convolute 128 than from the inner edge near the central axis 136 of the diaphragm 54. This can allow more movement (or less restriction to movement) at the outer edge of each convolute 128 and overall less stress on the diaphragm 54. In some embodiments, less stress on the diaphragm 54 can increase the number of cycles to failure and can improve pump reliability. In some embodiments, the angle between the first plane 118 and the third plane 130 can be between about 2 degrees and about 4 degrees.

The pressure in the pump 10 increases when one or more downstream valves (not shown) close. The increase in pressure is seen throughout the pump 10. However, the upstream side of the pump 10 is generally at a higher net fluid pressure than the downstream side of the pump 10. In some embodiments, the motor assembly 20 operates at a single speed when the pump 10 is turned on. When the downstream side of the pump 10 is not restricted by a downstream valve, the pump 10 can pump the nominal volume or flow rate of fluid. However, when a downstream valve closes to restrict the flow, a fluid pressure buildup is experienced in the downstream side of the pump 10. To prevent "water hammering" noise and vibration, the pump 10 can include a fluid bypass. Instead of using an external bypass conduit or port, the pump 10 can selectively bypass fluid internally using the diaphragm 54.

When a bypass pressure is exceeded at the pumping chamber 38, the pumping ability of the pump 10 can be reduced while maintaining a constant speed at the output shaft 70 of the motor assembly 20. In some embodiments, the convolutes 128 can provide the fluid bypass. When the bypass pressure is exceeded in the pumping chamber 38, the convolute 128 can flex or balloon outwardly from the pumping chamber 38 to increase the volume of the pumping chamber 38 during a pumping stroke. In some embodiments, this increase in volume can occur as the piston 62 is actuated into the pumping chamber 38. In some embodiments, the convolute 128 of the piston 62 can balloon from being generally concave (curved into the pumping chamber 38) to being generally convex (curved away from the pumping chamber 38) at or above the bypass pressure. In some embodiments, the convolute 128 can stretch significantly to enable the ballooning. In other embodiments, the convolute 128 does not stretch significantly, but bypasses fluid primarily by changing shape from generally concave to generally convex. In still other embodiments, the convolute 128 can both stretch and change shape from concave to convex.

As shown in FIG. 13A, each piston 62 can have a generally "crowned" shape. Moving from the tip of a piston 62 down toward the respective convolute 128, the piston 62 can have a continuous and gradually increasing diameter. The inner annulus 133 can depart from this increasing diameter substantially tangentially before joining a tight radius of the trough portion 131.

Figure 11B:
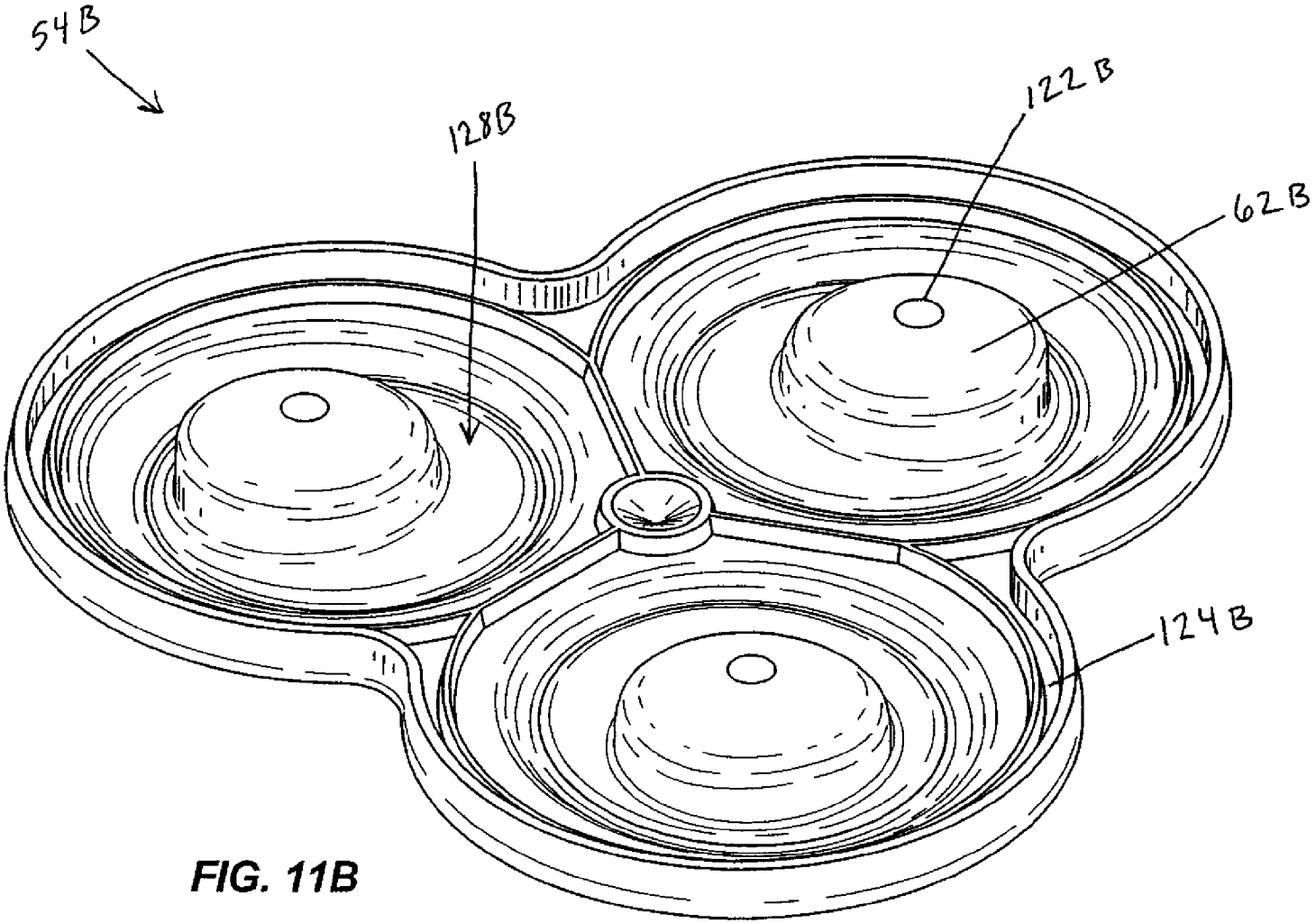
FIG. 11B is a perspective view of a diaphragm according to another embodiment of the invention for use with the pump of FIG. 1.
Figure 13B:
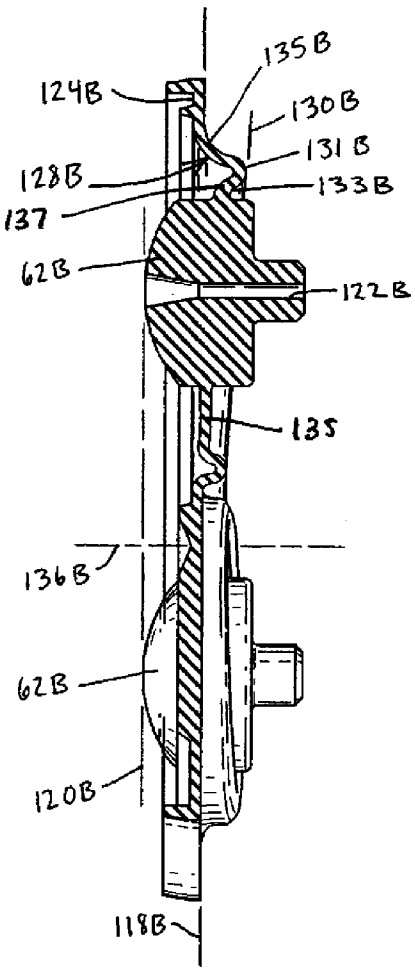
FIG. 13B is a cross-sectional view of the diaphragm of FIGS. 11B and 12B.
Figure 12B:
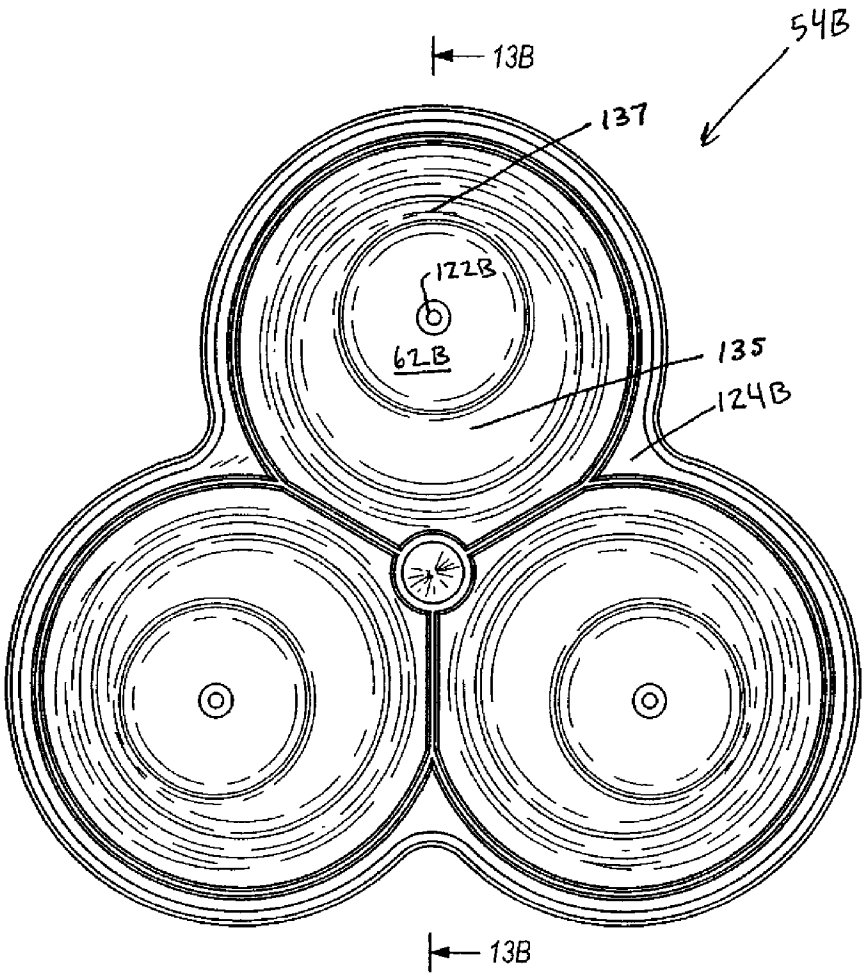
FIG. 12B is a front view of the diaphragm of FIG. 11B.

FIGS. 11B, 12B, and 13B illustrate another embodiment of a diaphragm 54B. In most aspects, the diaphragm 54B is similar to the diaphragm 54, with like reference numerals for like parts. In some embodiments, the diaphragm 54B can lie generally in a first plane 118B. The pistons 62B can lie generally in a second plane 120B, parallel to the first plane 118B. Each convolute 128B can include a trough portion 131B, an inner annulus 133B, and an outer annulus 135B. The inner annulus 133B can project outwardly from the piston 62B before curving into the trough portion 131B. In some embodiments, the inner annulus 133B can project substantially perpendicular to the piston 62B. The trough portion 131B of the convolute 128B can be oriented on a third plane 130B at an angle sloping away from the center 136B of the diaphragm 54B. In some embodiments, the angle between the third plane 130B and the first plane 118B can be between about 2 degrees and about 4 degrees.

Unlike the diaphragm 54, each piston 62B of the diaphragm 54B can be located at a distance from the center 136B that places the piston 62B closer to an outer edge 137 of the convolute 128B than to an inner edge 135 (near the center 136B), making the inner annulus 133B wider at the inner edge 135 and narrower at the outer edge 137. These characteristics of the diaphragm 54B can result in low stress levels. By reducing diaphragm stress, the life of the diaphragm 54B can be significantly increased improving reliability. The convolutes 128B can function within the pump 10 in a manner substantially similar to that described above with reference to FIGS. 11A, 12A, and 13A. Generally, the convolutes 128B can allow the pistons 62B to reciprocate with less stress on the diaphragm 54B and can provide for fluid bypass at or above the bypass pressure.

Figure 14:
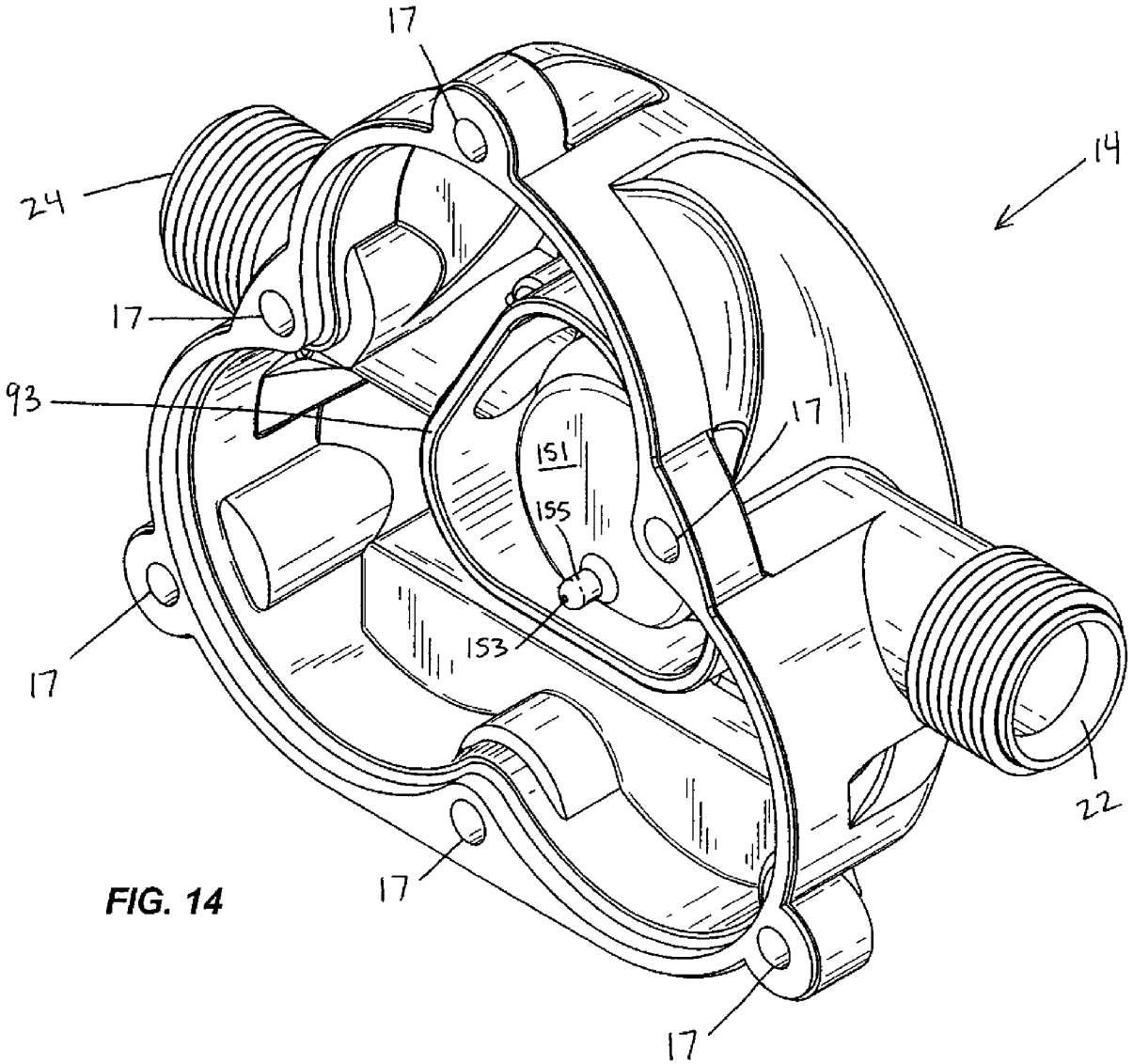
FIG. 14 is a perspective view of a front housing according to one embodiment of the invention for use with the pump of FIG. 1.
Figure 15:
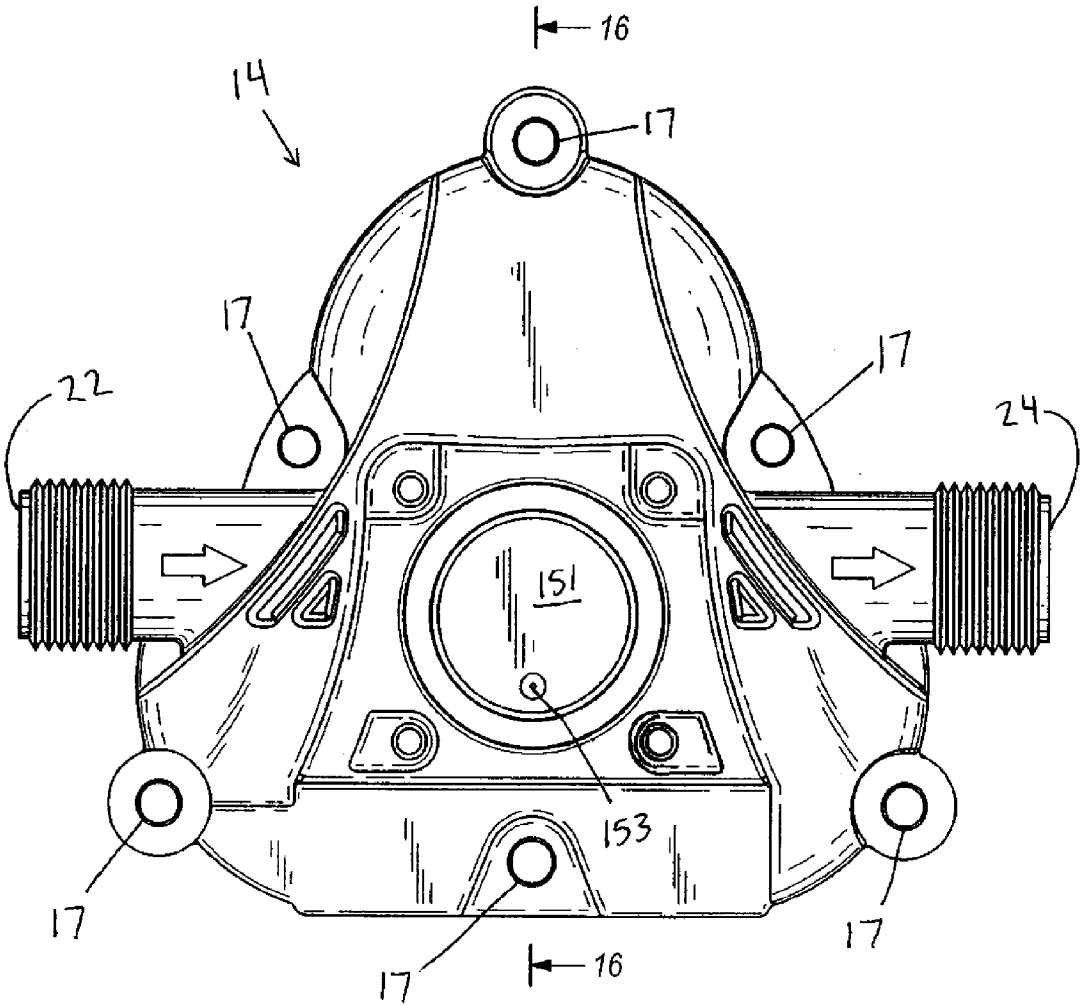
FIG. 15 is a front view of the front housing of FIG. 14.

FIGS. 14-17 illustrate the front housing 14 in detail. In some embodiments, both the fluid inlet 14 and the fluid outlet 18 can be formed integrally with the front housing 14. As shown in FIGS. 4-7, the valve assembly 36 can cooperate with the chamber wall 93 to seal the inlet chamber 92 apart from the outlet chamber 94. This can prevent leakage and can force fluid to travel from the inlet chamber 92 into the pumping chamber 38 and back out to the outlet chamber 94 before exiting the pump 10 at the fluid outlet 24. As shown in FIGS. 14 and 15, the front housing 14 can include mounting holes 17 for attachment to the rear housing 18 or other elements of the pump 10 (such as the motor assembly 20). In some embodiments, the front housing 14 can have six mounting holes 17 to attach the front housing 14 to the rear housing 18. Some of the mounting holes 17 can be used to mount the front housing 14 and the rear housing 18 to the motor assembly 20.

The switch housing 16 (as shown in FIGS. 1-3, but not shown in FIGS. 14-17) can be attached to the front portion of the front housing 14. The switch housing 16 can include the shut-off switch 140 within the pump head assembly 12 (as shown in FIGS. 4-7). In some embodiments, the shut-off switch 140 can be a normally-closed momentary switch. The shut-off switch 140 can include a sensor or an actuator, such as a diaphragm actuator 142, in fluid communication with fluid downstream of the pumping chamber 38. The shut-off switch 140 can also include an actuator spring 144 to bias the diaphragm actuator 142 to a normally-closed position. When sufficient fluid pressure (i.e., the shut-off pressure) is exerted on the diaphragm actuator 142, the bias force of the actuator spring 144 can be overcome, and the shut-off switch 140 can pivot about a pin 146 (as shown in FIGS. 4 and 6) to an open-circuit position, terminating power to the motor assembly 20. An adjustment screw 148 can be rotated by a user to set the value of the shut-off pressure. The shut-off pressure can be adjusted by varying a preload in the actuator spring 144 (i.e., by tightening or loosening the adjustment screw 148).

Figure 16:
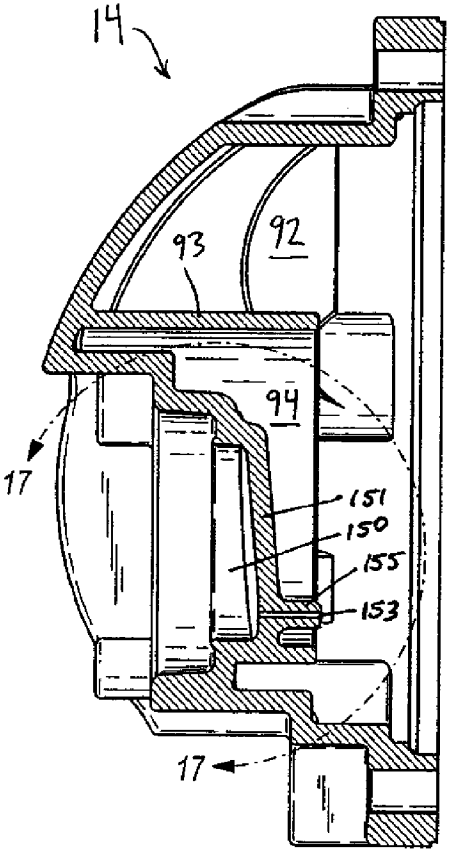
FIG. 16 is a cross-sectional view of the front housing of FIGS. 14-15.
Figure 17:
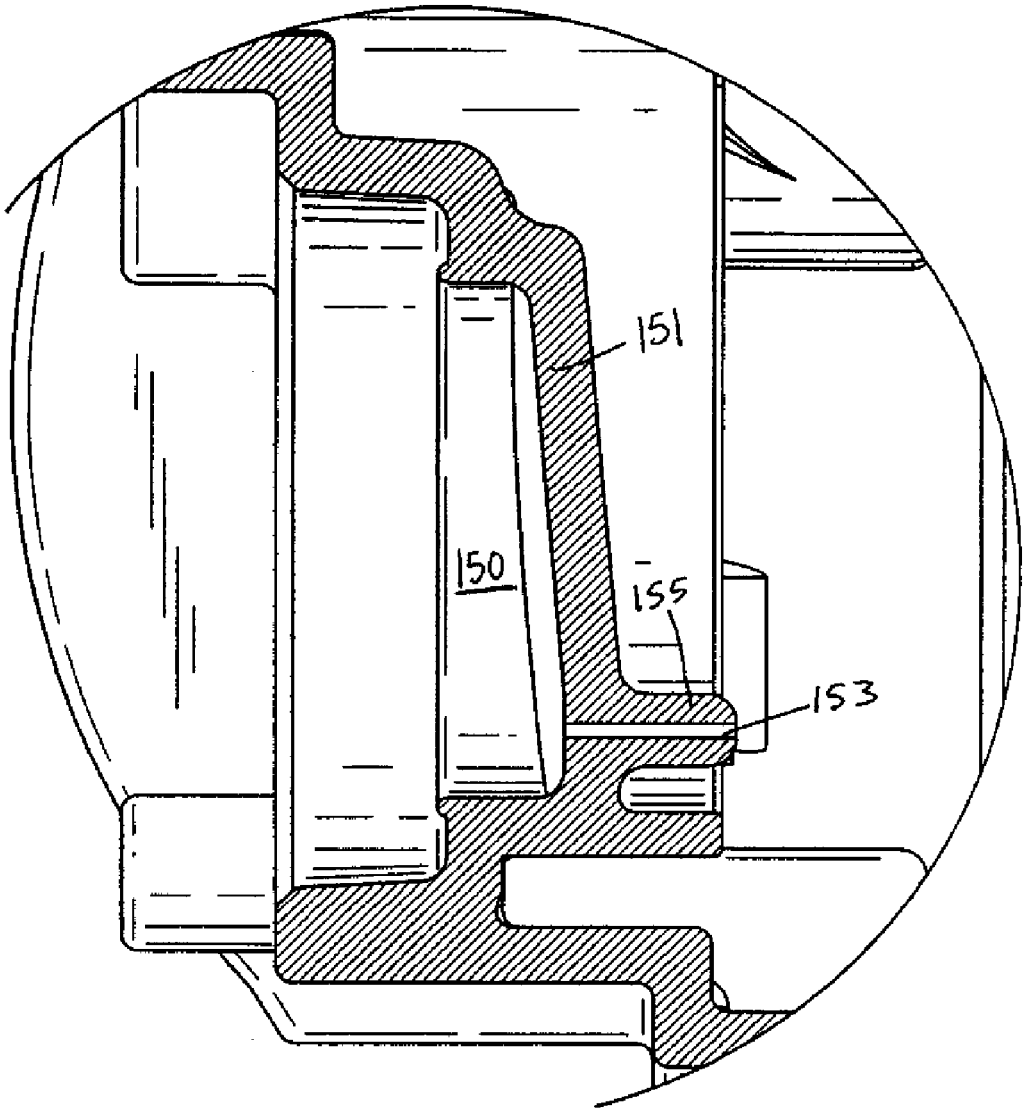
FIG. 17 is a detail cross-sectional view of the front housing enlarged from FIG. 16.

In some embodiments, the diaphragm actuator 142 can be positioned within a fluid reservoir, such as a pressure-dampening reservoir 150 (as shown in FIGS. 6, 7, and 17). Pressure dampening can help prevent unwanted cycling of the shut-off switch 140 as a result of pressure pulses that occur during the sequential pumping strokes of the pistons 62, 62B. Effective pressure dampening can increase pump efficiency and reduce noise. The pressure-dampening reservoir 150 can be located substantially adjacent to the outlet chamber 94, which can be at least partially defined by the chamber wall 93. As shown in FIGS. 16 and 17, a reservoir wall 151 can separate the pressure-dampening reservoir 150 from the outlet chamber 94. A pinhole aperture 153 can provide fluid communication between the pressure-dampening reservoir 150 and the outlet chamber 94. The pinhole aperture 153 can be a conduit with relatively high flow resistance through the reservoir wall 151. The pinhole aperture 153 can have an extended length (i.e., longer than the thickness of the reservoir wall 151), such as by forming a nipple 155 in the reservoir wall 151. Various lengths and diameters of the pinhole aperture 153 may be appropriate depending upon the level of pressure dampening desired. In some embodiments, the pinhole aperture 153 can be between about 0.02 inches and about 0.03 inches in diameter and about 0.3 inches in length.

The pressure-dampening reservoir 150 can isolate the shut-off switch 140 from pressure pulses in the outlet chamber 94. In order for the shut-off switch 140 to sense the prevailing fluid pressure trend in the outlet chamber 94, the pinhole aperture 153 can provide limited fluid flow between the pressure-dampening reservoir 150 and the outlet chamber 94. During normal operation of the pump 10, the pressure-dampening reservoir 150 can contain a quantity of fluid at a pressure relatively the same as that of the net pressure of the fluid in the outlet chamber 94. The high level of resistance to fluid flow through pinhole aperture 153 can help ensure that each time a pressure pulse occurs in the outlet chamber 94 from a pumping stroke, the fluid in the pressure-dampening reservoir 150 remains more constant, as the excess pressure is dissipated through other components of the pump 10 as well as relieved through the fluid outlet 24.

When the net operating pressure of the fluid in the outlet chamber 94 rises significantly, the fluid pressure in the pressure-dampening reservoir 150 will also rise, but will lag that of the outlet chamber 94. If the fluid pressure in the outlet chamber 94 reaches the shut-off pressure and stabilizes or continues to rise, the shut-off switch 140 can be actuated to turn off the pump 10. At that point, all pumping action can stop within the pump 10, and the pressure-dampening reservoir 150 can begin to drain and/or release pressure through the pinhole aperture 153. When the pressure-dampening reservoir 150 bleeds off enough pressure, the shut-off switch 140 can be returned to the normally-closed state by the actuator spring 144 and the pump 10 can be re-energized to resume pumping. In some embodiments, by providing pressure-dampened delay before either turning on or turning off the pump 10, the overall "on-off" activity of the pump 10 can be drastically reduced, which can increase the reliability of the shut-off switch 140 and can help to eliminate noise associated with excessive cycling.

Various features and advantages of the invention are set forth in the following claims.

The invention claimed is:

1. A pump comprising:

a pump head assembly defining an outlet chamber;

a fluid reservoir at least partially defined by a wall including a flow-restrictive conduit in fluid communication with the outlet chamber, the flow-restrictive conduit including a longitudinal axis; and a shut-off switch having an actuator in fluid communication with the fluid reservoir, the fluid reservoir, the flow-restrictive conduit substantially isolating the shut-off switch from pressure pulses in the outlet chamber, and the longitudinal axis of the flow-restrictive conduit does not intersect a center of the actuator.

2. The pump of claim 1, wherein the shut-off switch disconnects power from a motor.

3. The pump of claim 1, wherein the shut-off switch is actuated when a second fluid pressure in the fluid reservoir exceeds a shut-off pressure after a first fluid pressure in the outlet chamber has already exceeded the shut-off pressure.

4. The pump of claim 1, wherein the shut-off switch is biased with a spring and the shut-off pressure is adjustable by varying a pre-load on the spring.

5. The pump of claim 4, wherein the spring is coupled to an adjustment screw that rotates to vary the preload.

6. The pump of claim 1, wherein the shut-off switch is a normally-closed switch.

7. The pump of claim 1, wherein the actuator is a diaphragm actuator.

8. The pump of claim 1, wherein the fluid reservoir is a pressure-dampening reservoir that impedes movement of the actuator.

9. The pump of claim 1, wherein the flow-restrictive conduit is a pinhole aperture with a diameter of about 0.025 inches and a length of about 0.30 inches.

10. The pump of claim 1, wherein a length of the flow-restrictive conduit is greater than a thickness of the wall of the fluid reservoir.

11. A method of operating a pump, the method comprising:

providing a pump head assembly, the pump head assembly defining at least a portion of an outlet chamber;

positioning an actuator substantially adjacent to the outlet chamber;

receiving fluid within the outlet chamber;

positioning a fluid-restrictive conduit having longitudinal axis so that the longitudinal axis does not intersect a center of the actuator;

restricting flow into a fluid reservoir in fluid communication with the outlet chamber;

actuating a shut-off switch in fluid communication with the fluid reservoir when a pressure in the fluid reservoir exceeds a shut-off pressure; and isolating the shut-off switch from pressure pulses in the outlet chamber.

12. The method of claim 11, and further comprising disconnecting power from a motor when the pressure in the fluid reservoir exceeds the shut-off pressure.

13. The method of claim 11, and further comprising actuating the shut-off switch when a second fluid pressure in the fluid reservoir exceeds the shut-off pressure after a first fluid pressure in the outlet chamber has already exceeded the shut-off pressure.

14. The method of claim 11, and further comprising biasing the shut-off switch.

15. The method of claim 11, and further comprising adjusting the shut-off pressure.

16. The method of claim 15, and further comprising rotating an adjustment screw to adjust the shut-off pressure.

17. The pump of claim 1, wherein at least a portion of the wall including the flow-restrictive conduit extends into the outlet chamber and is unsupported by the outlet chamber.

18. A pump comprising:

a pump head assembly defining an outlet chamber;

a fluid reservoir at least partially defined by a wall including a flow-restrictive conduit in fluid communication with the outlet chamber, wherein at least a portion of the wall including the flow-restrictive conduit extends into the outlet chamber and is unsupported by the outlet chamber; and a shut-off switch having an actuator in fluid communication with the fluid reservoir, the fluid reservoir and the flow-restrictive conduit substantially isolating the shut-off switch from pressure pulses in the outlet chamber.

19. The pump of claim 18, wherein the flow-restrictive conduit includes a longitudinal axis that does not intersect a center of the actuator.

20. The pump of claim 18, wherein the shut-off switch disconnects power from a motor.

* * * * *